US005396789A

United States Patent [19]

Castellon

[11] Patent Number: 5,396,789

[45] Date of Patent: Mar. 14, 1995

[54] PROCEDURE FOR MANUFACTURING CORRUGATED TUBES

[76] Inventor: Melchor D. Castellon, Diputacion, 455-457, 08013 Barcelona, Spain

[21] Appl. No.: 87,396

[22] Filed: Jul. 8, 1993

[30] Foreign Application Priority Data

Jul. 9, 1992 [ES] Spain ..... 92/01414

[51] Int. Cl.[6] ..... B21D 15/06

[52] U.S. Cl. ..... 72/353.6; 72/393

[58] Field of Search ..... 72/353.4, 353.6, 354.2, 72/381, 383, 385, 399, 403; 29/454

[56] References Cited

U.S. PATENT DOCUMENTS 1,939,065 12/1993 Kruse ..... 72/403

3,726,121 4/1973 Arnold et al. ..... 72/403

FOREIGN PATENT DOCUMENTS 1247469 10/1960 France ..... 72/385

934975 8/1963 United Kingdom ..... 72/381

*Primary Examiner*—Lowell A. Larson

*Attorney, Agent, or Firm*—Jacobson, Price, Holman & Stern

[57] ABSTRACT

A procedure for manufacturing corrugated tubes includes providing an outer mold arranged to envelop a region of a tube to be deformed. The outer mold includes a plurality of flat annular elements capable of being displaced in a radial direction. A counter-mold is situated in the interior of the tube. The counter-mold includes identical and independent parts, radially displaceable simultaneously between an end position in which the independent parts are applied against the walls of the tube to cooperate with the pressing action of the annular elements of the outer mold to an opposite end position in which the independent parts are remote from the walls, allowing the corrugated tube to be removed from between the outer mold and the counter-mold.

2 Claims, 3 Drawing Sheets

PROCEDURE FOR MANUFACTURING CORRUGATED TUBES

Figure 1:
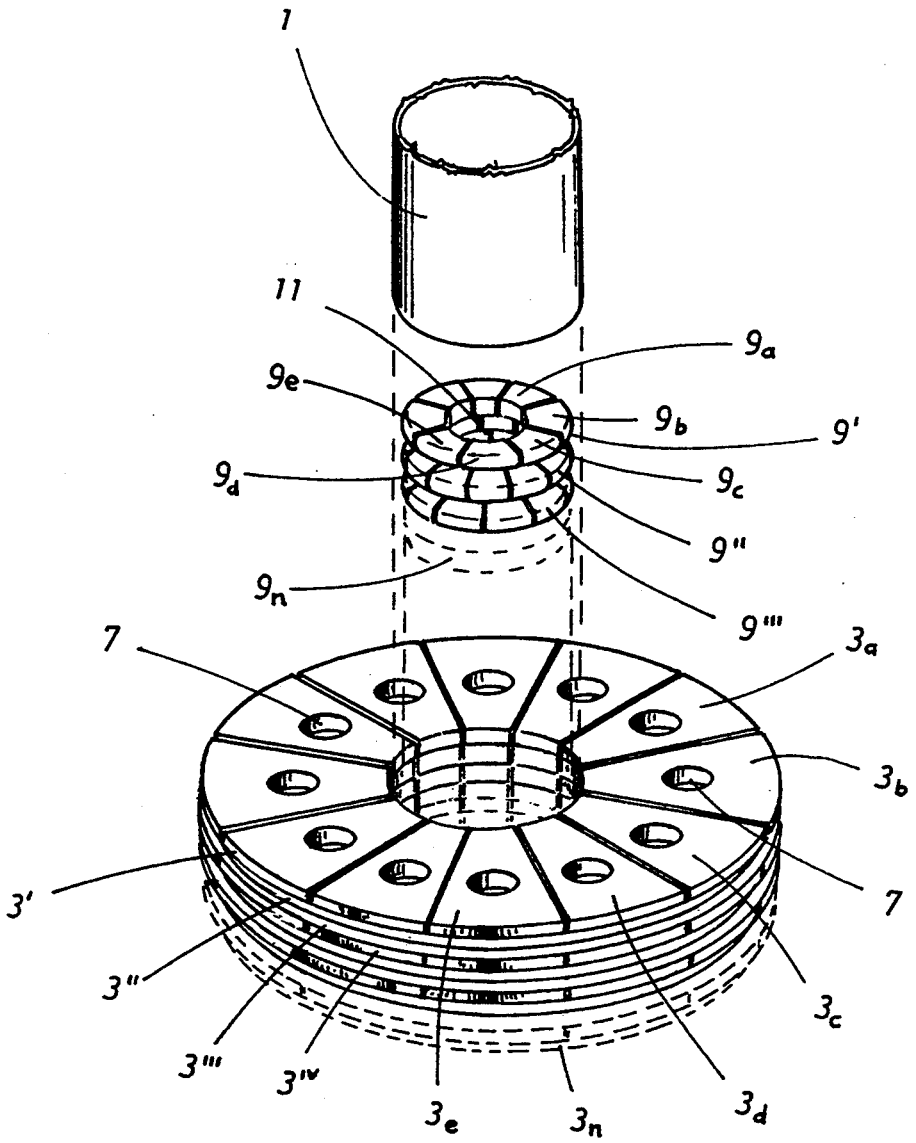

It is known that metal tubes provided over part of their length with a generatrix of undulating or uneven shape, having a succession of alternating peripheral projections and recesses, are used in numerous applications. These undulations serve, for example, to facilitate the operations of bending the tube, with a view to forming elbows of variable angle, or to reduce the rigidity of the tube in the face of axial forces. This letter is the case of those tubes in which the shafts of the steering of motor vehicles are lodged, it being important for them to be able to be deformed, experiencing a reduction if length, in the face of a frontal impact, in order to prevent them from being transformed into a dangerous weapon against the driver or the occupants of the vehicle.

At present, the procedure most generally used for the production of the corrugated tubes, that is to say of the tubes of the stated type, consists in the provision of a mould formed by two halves which fit and close over the region of the tube at which the undulation has to be produced, and in which halves there have been provided the succession of alternating ribs and channels which define the same. The fitting of the tube against the walls of the mould is effected by means of the introduction into that of a fluid under pressure, which forces them to expand. Excellent results are obtained with this procedure provided that the proportion between the diameter of the tube and the dimensions of the deformation which it is a question of producing in the same, that is to say the difference between the maximum and minimum diameter which the same has to have in the undulating region, is not greater than definite limits. As from these limits, unless work is effected with downright exaggerated wall thicknesses, tears inevitably occur at the points corresponding to the maximum outer diameter.

The said disadvantage, on the other hand, is common to absolutely all those procedures in which the deformation of the tube in order to constitute the undulating region is realised simultaneously in the whole of this region. It is easy to understand, indeed, that the very undulations in formation render impossible, or at least restrain in a very considerable manner, any displacement of material in the axial direction, creating tensions of great significance at the points corresponding to the maximum diameter.

The present invention has precisely as its object a procedure in which, essentially, the successive peripheral undulation which the finished final tube has to have are realised unitarily, one after the other, so that the material can always be displaced axially in one direction and is never subjected to exaggerated tension which may bring about a rent or which may give rise to an inadmissible weakening. With this method, in short, there are practically no limitations as regards the proportion between the diameter of the tube and the size of the deformation. In such conditions, it is understood that the method in question, still allowing of course a very wide range of applications, will be particularly suitable for the manufacture of corrugated tubes of reduced diameter, and, in a very special manner, of those tubes which are used to encase the shaft of the steering of motor vehicles.

For the said purposes, the procedure which is the object of the invention is based on the provision of an inner mould, which is introduced into the region of the tube which has to be corrugated, and an outer mould, which envelops this region, and which, essentially, is formed by a succession of superposed identical elements, in form the form of circular crown or hoop, each of which is formed, in its turn, by a certain number of identical sectors which can experience a certain displacement in the radial direction, between a position in which they apply the wall of the tube against the inner mould, and an opposite and position, in which they separate from the said wall, allowing the introduction of the tube that is to be corrugated and the extraction of the corrugated tube. With a view to this extraction, the inner mould is also formed by a certain number of radially displaceable parts.

In the stated conditions it is understood that it will be sufficient to actuate successively the elements which make up the outer mould, in order to produce also successively in the tube that is to be treated the peripheral undulations which are of interest, avoiding the tension to which reference has been made.

The invention will be able to be more easily understood on viewing the accompanying drawings, to which hereinunder the explanation will refer and in which, in a very schematic manner and, of course, without restrictive character of any type, a concrete example of practical realisation of the same has been shown.

IN THESE DRAWINGS

FIG. 1 is a schematic view in perspective of the whole of a tool for putting the invention into practice.

Figure 2:
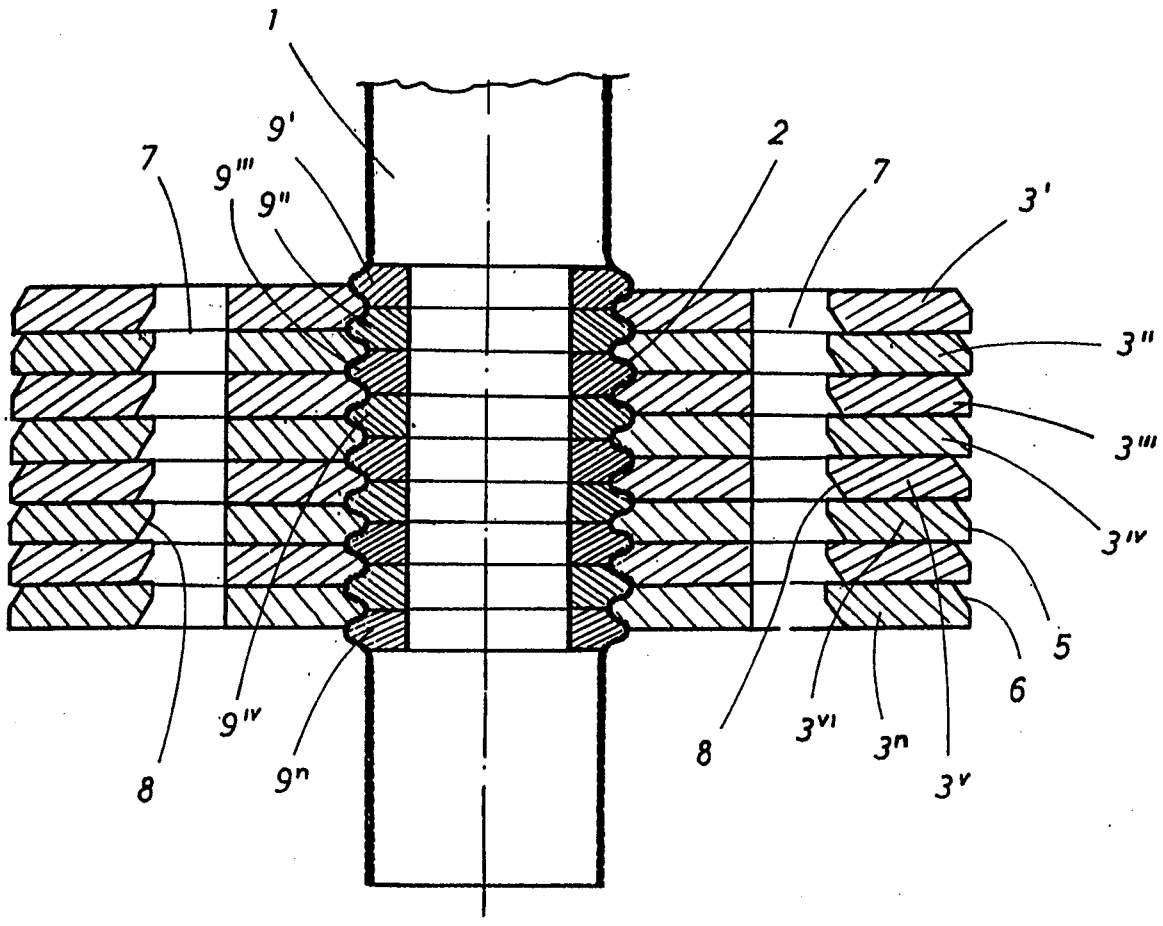
Figure 3:
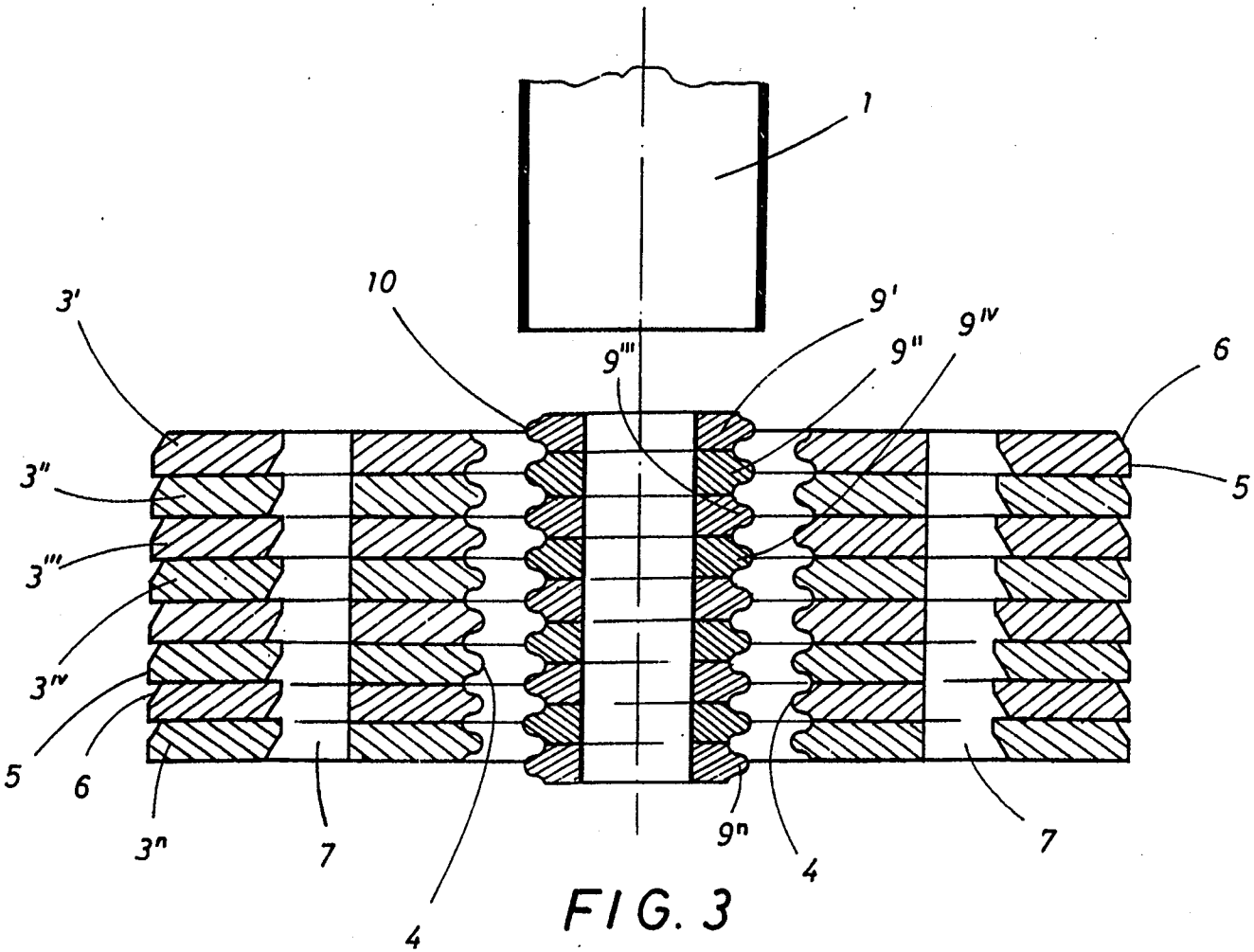

And FIGS. 2 and 3 are each diametric sections of the same tool shown in the previous Figure, with the elements which make it up situated in the one and the other of the two end positions which they are capable of adopting.

Referring, then, to these drawings

In accordance with the invention, for the formation in any metal tube whatsoever 1 of a corrugated zone 2 an inner mould is provided, which is introduced into that region, acting as a punch, to which reference will be made in more detail later on, and an outer mould essentially formed by a certain number of superposed identical elements $3^{I}$–$3^{II}$–$3^{III}$–$3^{IV}$–$3^{V}$–. . . $3^{n}$ each of which is made up, in its turn, by a certain number of independent identical parts 3*a*–3*b*–3*c*–3*d*–3*e*–. . . , in the form of a sector of a circular crown, completing a circle around the tube 1. These parts can be compelled to move in the radial direction, between a position (shown in FIG. 2) in which they act on the walls of the tube 1, applying them against the punch, and an opposite position (shown in FIG. 3) in which they are separated from these walls, allowing the extraction of the tube which has already been corrugated or the introduction of a new tube that is to be corrugated. It is understood that these displacements will be of a very reduced amount, being equivalent only to the difference existing between the maximum and minimum radii of the deformed tube.

In a preferred embodiment, each of the elements 3 which make up the outer mould will be designed to bring about a single one of the peripheral undulations of the corrugated region 2 of the tube, in combination—as is logical—with the inner mould, for which purpose the inner edges 4 of the successive sectors which make up the said element will be shaped defining the said undulation. However, it would be perfectly possible for each of the said elements to bring about the deformation, not of one only, but of two or more successive undulations, having at the said edges the shape suitable for such a purpose. This possibility, however, will exist solely when the relation between the diameter of the tube and the depth of the peripheral undulations which have to be brought about in the same is not situated below a certain limit, which will depend upon a series of factors (thickness, nature and quality of the material constituting the tube, concrete profils of the undulation, etc., etc.).

It is understood that the way of guiding and bringing about the displacement in the radial direction if the sectors which make up each of the elements which form the mould will be able to vary between the widest limits, still keeping within the framework of the invention. In a particularly simple and advantageous embodiment the outer edges 5 of the said sectors have a bevel or inclined region 6, in the manner of a slide, which makes it possible to actuate simultaneously all the integral sectors of each element, by means of the axial displacement of a ring (not shown in the drawings) which embraces them and which has on its inner edge a chamfer having the same inclination as the said bevel. This same ring, on being displaced axially, will successively act on the separate elements or "storeys" of the outer mould, forcing them to apply the tube 1 against the inner mould. In this same preferred embodiment, the sectors 3 each have orifices 7, provided with a chamfer or inclined edge 8, on which there can act the end—inclined to the same extent—of a rod (not shown) which, through a slide effect, will bring about the backward motion thereof, separating the edge 4 from the region 2 of the tube which has already been corrugated. It is understood that there will have to exist as many rods as each element of the mould comprises sectors, and it is understood that each rod will act successively, compelling them to move in the stated direction, on all the superposed sectors which the mould comprises.

In the preferred embodiment to which allusion has repeatedly been made the inner mould acts like a punch and merely has to be able to contract in order to make removal from the mould possible once the corrugating operation is finished. In this embodiment, the said mould is also made up of a succession of storeys or identical elements which are superposed $9^{I}$–$9^{II}$–$9^{III}$–$9^{IV}$–. . . $9^{n}$, each of which is made up, in its turn, of a certain number of identical sectors *9a–9b–9c–9d–9e* . . . As can be seen in FIGS. 2 and 3, these elements will preferably be situated staggered with respect to the elements which make up the outer mould, and have their outer edges 10 provided with the profile corresponding to one of the peripheral undulations which have to be brought about in the corrugated tube, so that the concave part of each of these undulations is brought about by two superposed inner elements and a single outer element, while the convex part is brought about by a single inner element and two outer elements. It is also preferable for the said inner and outer elements not to be formed by the same number of parts or, in any case, for these parts to be displaced in revolution so that the radial joints existing between the successive parts do not coincide in the two elements.

As has already been indicated on the subject of the outer mould, the way of guiding and bringing about the displacements in the radial direction, in the one or the other direction, of the sectors which make up each of the elements or storeys of the inner mould, will be able to vary between the widest limits without this meaning departing from the framework of the invention. These movements, on the other hand, will be able to affect simultaneously the entire set of integral elements of the mould, or, as essentially occurs in the outer mould, be produced successively. Moreover, and in the same way as has already been indicated in relation to the outer mould, each element will be able to have on its outer edge the profile corresponding to a single undulation or to two or more of them, the inner mould even being able to be constituted on the basis of a single element, which will shape the whole of the corrugated region, divided into a succession of independent cylindrical sectors, capable of carrying out a certain displacement in the radial direction.

In the exemplified embodiment shown in the drawings, each of the elements 9 adopts an annular shape, having a large central circular aperture 11, through which the entire set of these elements is traversed by a shaft capable of being displaced axially and provided with two regions of different diameters, joined together by a conical region. The diameter of the region of this shaft against which the sectors 9 are at any moment supported determines, obviously, the radial position of the same, and the conical connecting region between the two cylindrical regions is designed to develop a slide effect on the parts *9a–9b–9c–9d* . . . which make up each of the "storeys" or elements of the inner mould, so that it brings about the simultaneous displacement of all the parts which make up each element, acting successively on all of them and causing the radial displacement of the said parts from the inactive position to the active position. As is logical, in the opposite axial movement there occurs the freeing of all the said parts from the active position to the inactive position, in which they allow extraction of the corrugated tube and introduction of a new tube that is to be corrugated.

It is understood that the invention cannot in any way be considered as restricted to the schematic exemplified embodiment described and shown, but that, within what constitutes its essence, it allows numerous modifications, some of which have already been indicated and all of which, as is logical, will have to be considered to be fully included within the framework of the invention. In particular, a maximum of variations will be possible as fully regards the number of integral elements of the moulds, the number of radially displaceable parts which will form each of the said elements, and, very especially, the way of bringing about the radial displacements, in the one or other direction, of these parts, for which purpose it will be possible to adapt or devise very different systems from the ones which have been schematically suggested in the preceding description, pneumatic, hydraulic, elastic, etc. solutions which are very different from the purely mechanical ones to which reference has been made being perfectly able to be provided.

I claim:

1. A procedure for manufacturing corrugated tubes, said procedure comprising:

providing an outer mould formed by a plurality of flat annular elements, mutually identical, superposed and independent, arranged to envelop a region of a tube to be deformed, each of said plurality of flat annular elements is composed, in its turn, by at least two identical and independent parts, each forming a sector of a circular crown, capable of being displaced in a radial direction and displaceable simultaneously, between two end positions, under the action of a control system which acts successively on said annular elements, compelling the parts which make up each of said annular elements to pass from a position in which inner edges of said annular elements are remote from walls of the tube, permitting the introduction of the tube that is to be deformed and the extraction of the deformed tube, to a position in which said annular elements apply the walls of the tube against a counter-mould situated in an interior of the tube, obliging the walls of the tube to be deformed and bringing about successively in the walls of the tube, corresponding peripheral undulations, profiling the annular elements of the outer mould to have an outer edge with an inclined edge for cooperating with the control system for radially inward movement of the annular elements of the outer mould to engage the tube, profiling aligned orifices of the annular elements of the outer mould to have an inclined edge for cooperating with the control system for radially outward movement to move the annular elements of the outer mould away from the tube, situating the counter-mould in the interior of the tube constituted by a central circular aperture defined in a middle of a plurality of flat elements, mutually identical, superposed and independent, each of which is formed, in its turn, by at least two identical and independent parts, radially displaceable simultaneously between an end position in which the independent parts are applied against the walls of the tube, to cooperate with the pressing action exerted successively by the annular elements of the outer mould, and an opposite end position, in which the independent parts are remote from the walls, allowing the corrugated tube to be removed from between the outer mould and the counter-mould, and positioning radial joints between said plurality of flat annular elements of said outer mould offset from radial joints of said plurality of flat elements of said counter-mould, said plurality of flat annular elements of said outer mould being of a different number than said plurality of flat annular elements of said counter-mould.

2. The procedure according to claim 1, further comprising:

profiling the elements of the outer mould to have an inner edge with a peripheral undulation to provide an undulation in the tube, and profiling the elements of the counter-mould at an outer edge with a peripheral undulation to provide an undulation in the tube.

* * * * *